US010833435B2

(12) United States Patent
Villard et al.

(10) Patent No.: US 10,833,435 B2
(45) Date of Patent: Nov. 10, 2020

(54) ELECTRICAL CONNECTION SYSTEM WITH A CONDUCTIVE BLADE

(71) Applicant: Tyco Electronics Services GmbH, Schaffhausen (CH)

(72) Inventors: Romain Villard, Tassin la Demi Lune (FR); Yannick Villardier, Mions (FR)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

(21) Appl. No.: 16/337,212

(22) PCT Filed: Sep. 29, 2016

(86) PCT No.: PCT/EP2016/073297
§ 371 (c)(1),
(2) Date: Mar. 27, 2019

(87) PCT Pub. No.: WO2018/059694
PCT Pub. Date: Apr. 5, 2018

(65) Prior Publication Data

US 2019/0296460 A1 Sep. 26, 2019

(51) Int. Cl.
*H01R 13/18* (2006.01)
*H01R 9/26* (2006.01)
(Continued)

(52) U.S. Cl.
CPC ..... *H01R 9/2608* (2013.01); *H01R 11/05* (2013.01); *H01R 13/113* (2013.01); *H01R 13/18* (2013.01);
(Continued)

(58) Field of Classification Search
CPC .... H01R 9/2608; H01R 11/05; H01R 13/113; H01R 13/193; H01R 13/18; H01R 25/142; H01R 9/2691; H01R 4/4827
See application file for complete search history.

(56) References Cited

U.S. PATENT DOCUMENTS 5,022,873 A * 6/1991 Kollmann ..... H01R 9/2691 439/716
5,890,916 A 4/1999 Diekmann et al.
(Continued)

FOREIGN PATENT DOCUMENTS

CN 102593616 A 7/2012
DE 20120811 U1 4/2003
(Continued)

OTHER PUBLICATIONS

English Machine Translatiopn of Abstract DE102004045026.
(Continued)

*Primary Examiner* — Truc T Nguyen
(74) *Attorney, Agent, or Firm* — Cantor Colburn LLP

(57) ABSTRACT

The invention relates to an electrical connection system (7) for an electrical device, such as an electrical terminal block, said electrical connection system (7) comprising: a conductive bar (21) including an electrical contact region (45) arranged to cooperate with a conductive portion (13') of an electrical conductor (13) in a connected position, and an engagement zone (35) arranged to engage with a portion (15') of a support rail (15) in an engaged position; a leaf spring (23); and a retaining device (49) arranged to retain the support rail (15) in the engaged position, the conductive bar (21) consisting of a conductive strip.

19 Claims, 4 Drawing Sheets

(51) Int. Cl.

| | |
|---|---|
| ***H01R 25/14*** | (2006.01) |
| ***H01R 11/05*** | (2006.01) |
| ***H01R 13/11*** | (2006.01) |
| ***H01R 13/193*** | (2006.01) |
| *H01R 4/48* | (2006.01) |

(52) U.S. Cl.
CPC ..... *H01R 13/193* (2013.01); *H01R 25/142* (2013.01); *H01R 4/4827* (2013.01); *H01R 9/2691* (2013.01)

(56) References Cited

U.S. PATENT DOCUMENTS

| | | | | |
|---|---|---|---|---|
| 7,686,626 | B2 * | 3/2010 | Wu | H01R 4/64 439/95 |
| 7,922,521 | B1 * | 4/2011 | Wu | H01R 9/2691 439/532 |
| 7,927,132 | B1 | 4/2011 | Lin | |
| 2001/0051466 | A1 * | 12/2001 | Bechaz | H01R 9/2691 439/716 |
| 2005/0079773 | A1 | 4/2005 | Prokup et al. | |
| 2005/0085107 | A1 | 4/2005 | Hackemack et al. | |
| 2006/0063419 | A1 | 3/2006 | Steinkemper et al. | |
| 2008/0102715 | A1 * | 5/2008 | Coffy | H01R 9/2675 439/816 |
| 2008/0233782 | A1 * | 9/2008 | Hoppmann | H01R 13/501 439/259 |
| 2009/0035998 | A1 | 2/2009 | Schrader | |
| 2010/0173531 | A1 | 7/2010 | Holste | |
| 2013/0133716 | A1 * | 5/2013 | Buettner | H01L 31/05 136/244 |
| 2016/0248174 | A1 * | 8/2016 | Ludewig | H01R 9/223 |
| 2016/0314911 | A1 * | 10/2016 | Knoerrchen | H01R 9/2691 |
| 2017/0025805 | A1 * | 1/2017 | Pizzi | H01R 9/2675 |
| 2019/0229440 | A1 | 7/2019 | Villard et al. | |
| 2019/0305448 | A1 | 10/2019 | Villard et al. | |

FOREIGN PATENT DOCUMENTS

| | | |
|---|---|---|
| DE | 20305313 U1 | 8/2004 |
| DE | 102004045026 B3 | 2/2006 |
| FR | 2844105 | 3/2004 |
| WO | 2004021521 | 3/2004 |

OTHER PUBLICATIONS

English Machine Translatiopn of Abstract DE20305313.
International Search Report for Application No. PCT/EP2016/073297.
Written Opinion for Application No. PCT/EP2016/073297.
International Search Report for Application No. PCT/EP2016/073298.
Written Opinion for Application No. PCT/EP2016/073298.
English Machine Translation Abstract of CN102593616.
International Search Report for Application No. PCT/EP2016/073300.
Written Opinion for Application No. PCT/EP2016/073300.
U.S. Office Action for U.S. Appl. No. 16/337,237, dated Jun. 23, 2020.
U.S. Office Action for U.S. Appl. No. 16/337,199, dated Sep. 26, 2019.
U.S. Office Action for U.S. Appl. No. 16/337,199, dated Apr. 9, 2020.
U.S. Notice of Allowance for U.S. Appl. No. 16/337,199, dated Jul. 8, 2020.

* cited by examiner

ELECTRICAL CONNECTION SYSTEM WITH A CONDUCTIVE BLADE

CROSS REFERENCE TO RELATED APPLICATIONS

This application is a National Stage of PCT Application No. PCT/EP2016/073297 filed on Sep. 29, 2016, the contents of which are incorporated herein by reference thereto.

TECHNICAL FIELD

The present invention concerns an electrical connection system for an electrical apparatus such as a junction block, the system comprising a conductive blade.

BACKGROUND

It is known to use a junction block comprising an electrical connection system allowing electrically connecting an electrical conductor and a support rail.

This junction block type also comprises other sockets for connecting electrical conductors with conductive strips comprised in the body of the block.

The number of sockets implies a particular geometry of the junction block so as not to overpass the required room in an electrical box. It is also necessary to limit the amount of material used and to avoid generating falls during the manufacture.

BRIEF SUMMARY

The present invention aims at solving all or part of the aforementioned drawbacks.

To this end, the present invention concerns an electrical connection system for an electrical apparatus such as a junction block, the electrical connection system comprising:

- a conductive strip having an electrical contact location arranged to cooperate with a conductive portion of an electrical conductor in a connection position and a cooperation area arranged to cooperate with a portion of a support rail in a cooperation position,
- a clamping device arranged to hold the conductive portion in the connection position, such as a leaf spring comprising a bearing branch arranged to be mounted to the conductive strip and a clamping branch arranged to hold the conductive portion in the connection position,
- a holding device arranged to hold the support rail in the cooperation position, the conductive strip is constituted by a conductive blade comprising a first portion and a second portion, the first portion facing the second portion.

This arrangement facilitates the manufacture of the conductive strip because it originates from a planar blade which is then transformed. The mass manufacture of this single conductive part therefore allows saving production time and reducing the transformation costs in comparison with a system comprising several conductive parts.

Also, a saving of material is achieved because a base sheet metal can generate a large number of blades, material falls being reduced.

This arrangement allows making a compact electrical connection system. This arrangement further allows adapting the position of the leaf spring according to the geometrical constraints due to the shape of the junction block.

According to another aspect of the invention, the clamping device is a device equivalent to the leaf spring, this device being arranged to hold the conductive portion in the connection position with the conductive strip.

In this case, the additional leaf spring can be qualified as a leaf spring for holding the portion of the support rail. Indeed, in this case, the qualifier «additional» no longer applies to this leaf spring.

According to this other aspect of the invention, the clamping device is a screw clamping device.

According to an aspect of the invention, the conductive blade is comprised within a rectangular contour.

Indeed, since the blade is a rectangle, it is easy to find an arrangement of the cutouts to be made on the base sheet metal so as to minimize the falls and produce as many conductive strips as possible.

According to an aspect of the invention, the conductive strip has an end portion folded transversely to the direction of extension of the first portion, said end portion being arranged to cooperate with a transverse portion of the portion of the support rail in the cooperation position.

This arrangement enables a good wedging of the support rail relative to the conductive strip in the cooperation position because there are two transverse cooperation surfaces.

According to an aspect of the invention, the conductive strip has a U-like general shape.

This arrangement allows making the conductive strip from a rectilinear blade which is then folded. This arrangement enables a saving of material because a base sheet metal which is cut into rectilinear blades generates few falls, that is to say few material loss.

According to an aspect of the invention, the conductive strip comprises two connection branches each provided with a portion of the cooperation area.

This arrangement allows ensuring a good electrical contact in the cooperation position.

According to an aspect of the invention, each connection branch has a through opening configured for the passage of a portion of the holding device into the cooperation position.

This arrangement enables an improvement in the flow of the current, the current passage section comprising four passage channels.

According to an aspect of the invention, said one through opening corresponds to a reduction comprised between 10% and 50% of a nominal section over a defined length of said at least one corresponding connection branch.

The nominal section is a section of said at least one corresponding connection branch remote from the through opening.

Preferably, the reduction is comprised between 10% and 40% and in particular between 15% and 30%.

This arrangement quantifies the acceptable section reduction for the current to be properly transmitted despite the through opening.

According to an aspect of the invention, the through openings of the connection branches face each other.

This arrangement allows easy insertion of the holding device into the conductive strip to position it in the cooperation position.

According to an aspect of the invention, the first through opening and the second through opening are symmetrical with respect to a central plane.

This symmetry enables a good holding in position of the portion of the support rail because the clamping forces are distributed evenly.

This arrangement also facilitates the installation of the holding device: there is no risk of blockage of the holding device during its installation in the cooperation position.

According to an aspect of the invention, each connection branch has a cooperation extension arranged to cooperate with the portion of the support rail in the cooperation position.

This arrangement enables an effective clamping of the portion of the support rail in the cooperation position and also ensuring a good electrical contact.

According to an aspect of the invention, the cooperation extensions of the connection branches extend along the same axis in the cooperation position.

This arrangement improves the cooperation between the connection branches and the conductive strip in the cooperation position.

According to an aspect of the invention, at least one connection branch further has a cooperation stop extending transversely to the cooperation extension.

This arrangement enables a good holding in the cooperation position of the portion of the support rail.

Indeed, in the cooperation position, the portion of the support rail comprises a first portion extending in a first plane cooperating with the cooperation extension and comprises a second portion extending in a second plane transverse to the first plane cooperating with the cooperation stop.

This cooperation according to two transverse portion enables a good respective positioning of the support rail and the electrical connection system in the cooperation position.

The risk of inadvertent movement in the cooperation position and therefore of interruption of electrical contact between the support rail and the conductive strip are thus limited.

According to an aspect of the invention, the cooperation stop is obtained from the folding of an end portion of the corresponding branch.

According to an aspect of the invention, the holding device comprises a clamping spring provided with two ends facing each other, each end being arranged to cooperate with a clamping location of a corresponding connection branch.

This arrangement allows holding the connection branches in the cooperation position reliably.

According to an aspect of the invention, at least one clamping location is formed in a cavity of the corresponding connection branch, said location being arranged to receive a corresponding end of the clamping spring.

This arrangement enables a simple set-up of the clamping spring on the connection branches. The ends of the clamping spring are thus held in the cavities. There is no risk of displacement of the clamping spring relative to the connection branches.

According to an aspect of the invention, each connection branch comprises a cavity as described hereinbefore.

According to one aspect of the invention, for each connection branch, the cavity and the extension are aligned in a direction transverse to the direction of extension of the corresponding branch.

This arrangement enables an optimal application of the clamping force of the clamping spring at the level of the extensions, which implies a good holding in position of the portion of the clamping rail in the cooperation position.

According to an aspect of the invention, each cooperation branch corresponds to a folded blade portion generating the cavity and the extension.

This arrangement enables a simple and inexpensive manufacture of the conductive strip.

Also, the cavity has a furrow-like shape which allows disposing easily each end of the clamping spring in the corresponding clamping location laterally with respect to the direction of extension of the corresponding branch.

According to an aspect of the invention, the clamping spring is C-shaped.

According to an aspect of the invention, the conductive strip has a passage opening for the insertion of the conductive portion into the connection position.

This arrangement allows making the conductive strip in one-piece having no weakened points because the current can still be transmitted in sufficient quantities by the two lateral branches generated by the opening.

According to an aspect of the invention, the holding device comprises an additional leaf spring provided with an additional bearing branch arranged to be mounted to the conductive strip and an additional clamping branch arranged to cooperate with the portion of the support rail in the cooperation position.

This arrangement allows designing a simple and reliable electrical connection system. Indeed, the fact of providing for one single conductive strip electrically connecting the support rail and the electrical conductor allows for a good electrical connection while reducing the number of parts of the system to a minimum.

Material-savings can be achieved as well as the reduction of the transformations of the base materials used in the manufacture of the conductive strip, the leaf spring and the additional leaf spring.

According to an aspect of the invention, the leaf spring and the additional leaf spring are identical. This arrangement allows standardizing this part, which reduces the number of references and facilitates the management of the parts during the manufacture of the electrical connection system.

According to an aspect of the invention, the bearing branch extends in a plane transverse to the plane of extension of the additional bearing branch.

This arrangement allows designing a junction block in which the direction of insertion of the electrical conductor can be adapted according to the geometrical constraints.

According to an aspect of the invention, the additional bearing branch extends in the continuation of the second portion of the conductive strip, the cooperation area being formed in the first portion of the conductive strip.

This arrangement allows making a clip for holding in position the portion of the support rail with the cooperation area and the additional clamping branch.

Thus, the portion of the support rail is effectively held in the cooperation position.

The present invention also concerns a junction block comprising an insulating body in which an electrical connection system as previously described above is formed.

According to an aspect of the invention, the insulating body comprises a support portion of the bearing branch and/or an additional support portion of the additional bearing branch.

This arrangement allows ensuring the blocking of the bearing branch when the clamping branch is urged and the same for the additional bearing branch and the additional support portion.

Anyway, the invention will be better understood from the following description made with reference to the appended schematic drawings representing, as a non-limiting example, an embodiment of this electrical connection system.

DETAILED DESCRIPTION

Figure 1:
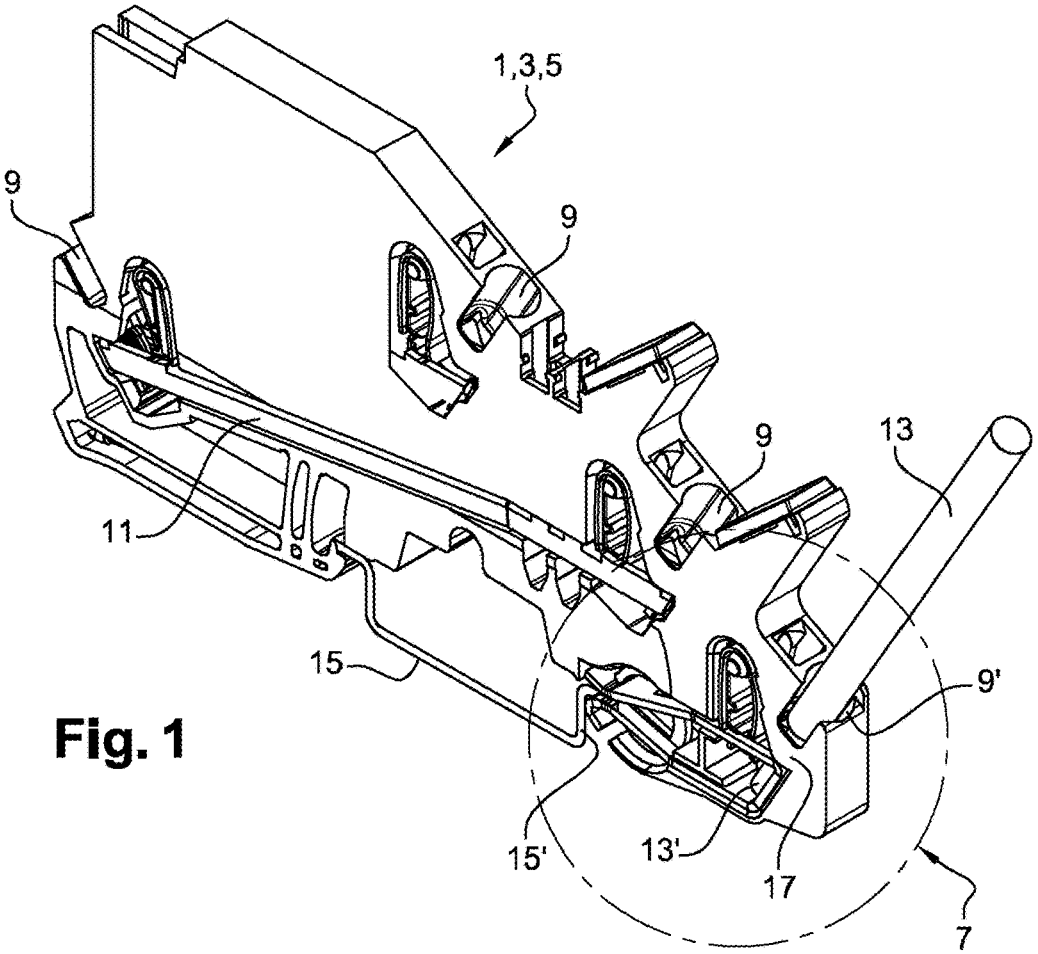
FIG. 1 is a perspective view of a junction block, an electrical conductor and a support rail.
Figure 2:
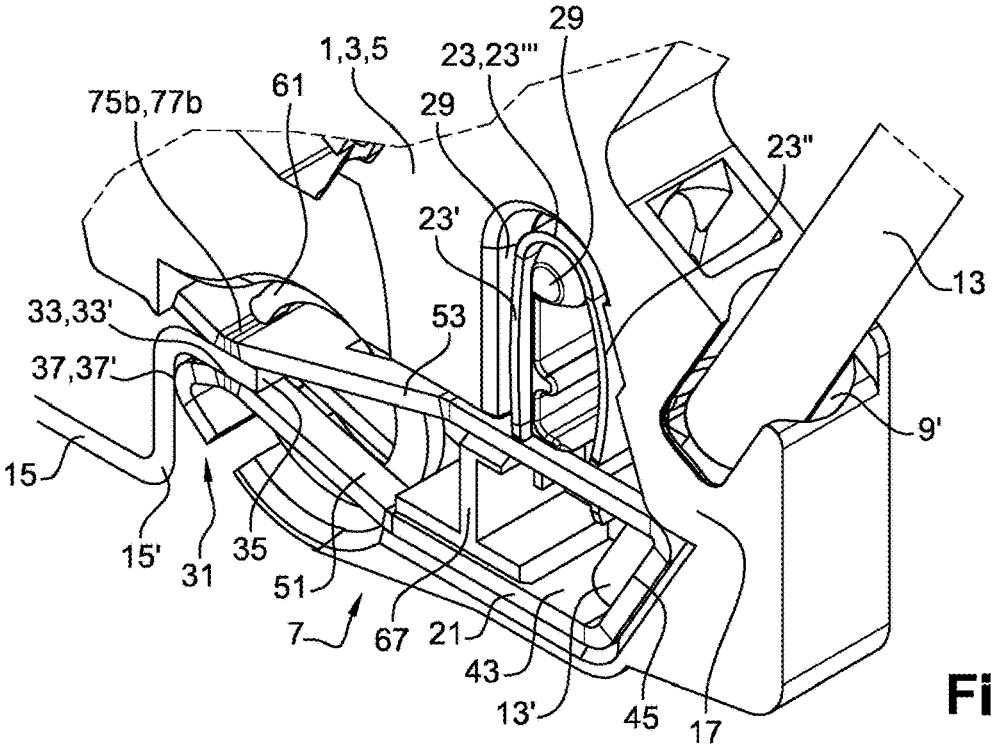
FIG. 2 is a detail view of FIG. 1.
Figure 3:
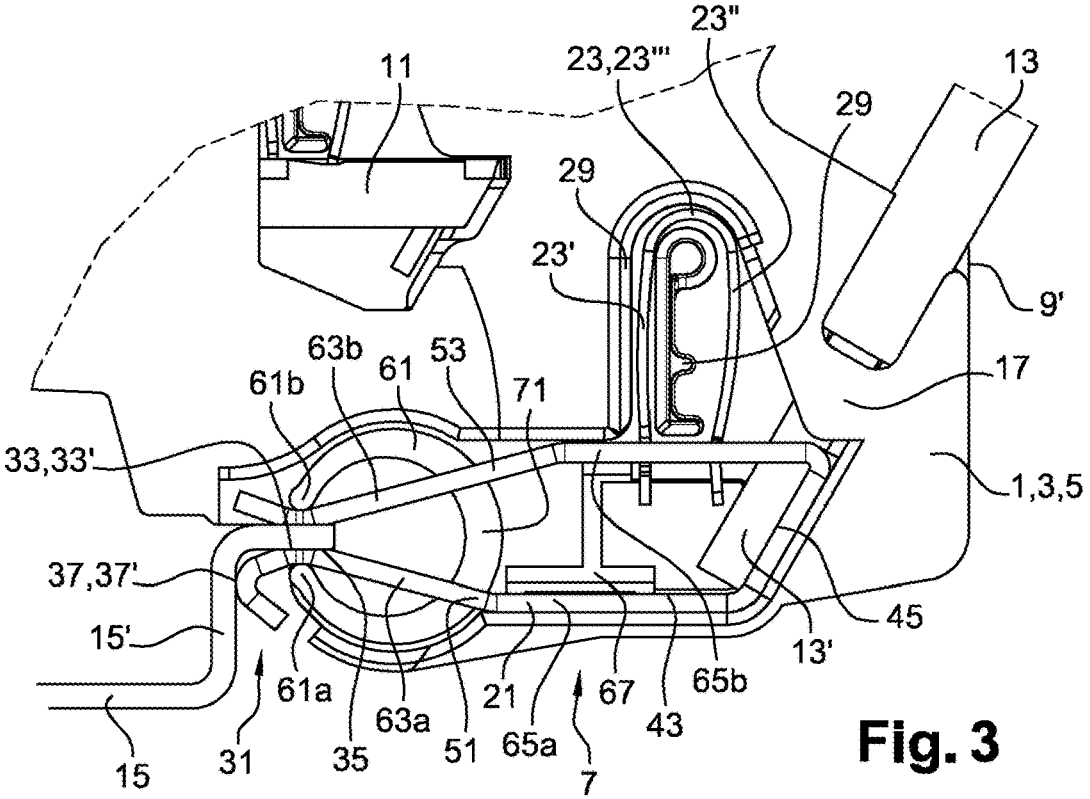
FIG. 3 is a front view of a detail of the junction block comprising an electrical connection system.
Figure 4:
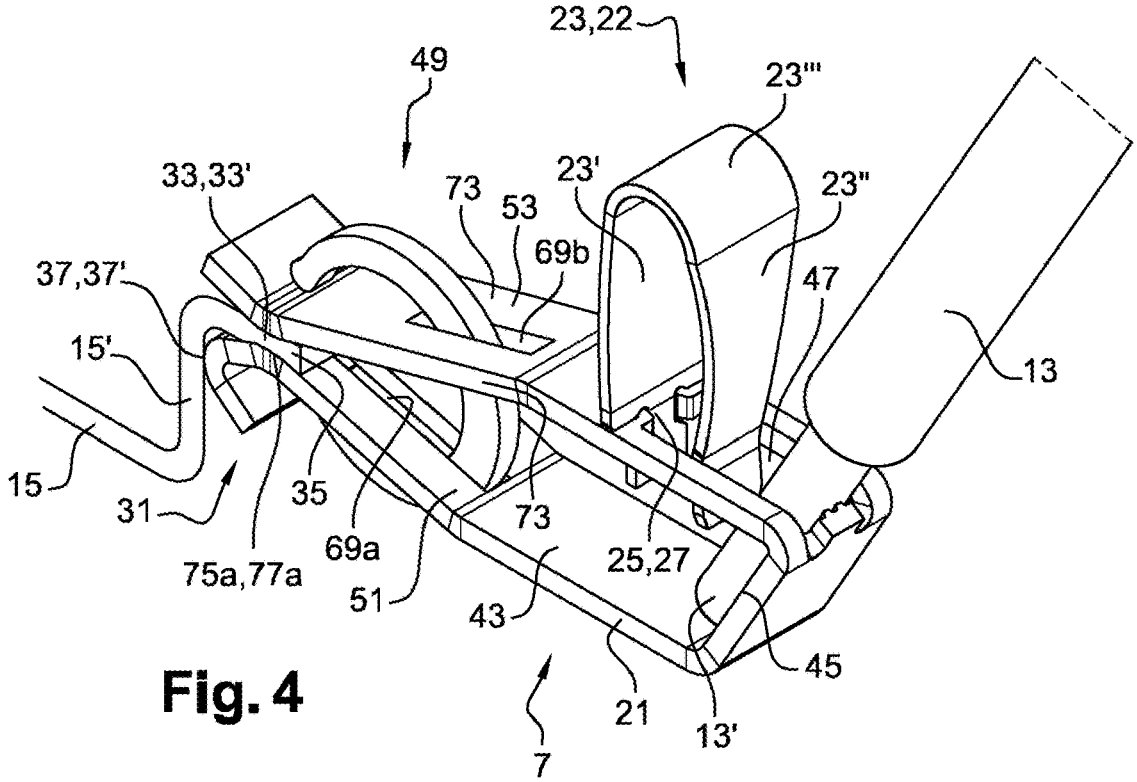
FIG. 4 is a perspective view of the electrical connection system, the electrical conductor and the support rail.
Figure 5:
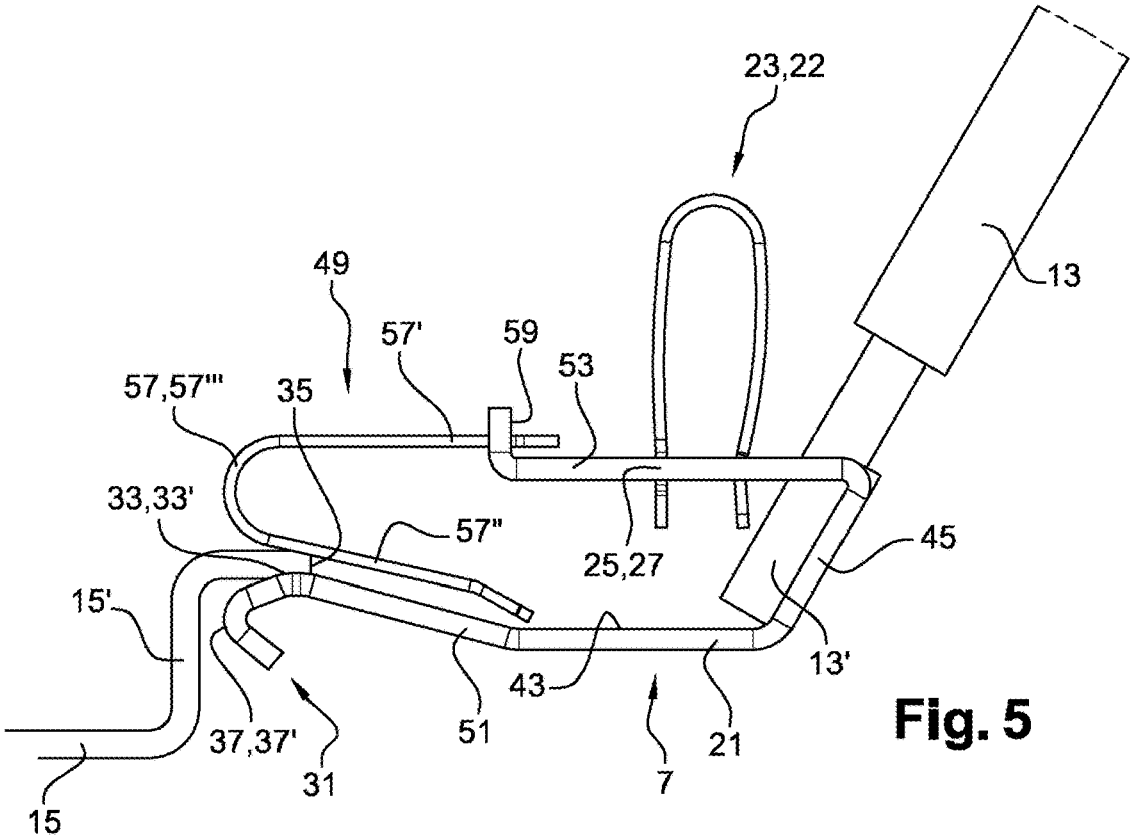
FIG. 5 is a front view of a variant of the electrical connection system, the electrical conductor and the support rail.
Figure 6:
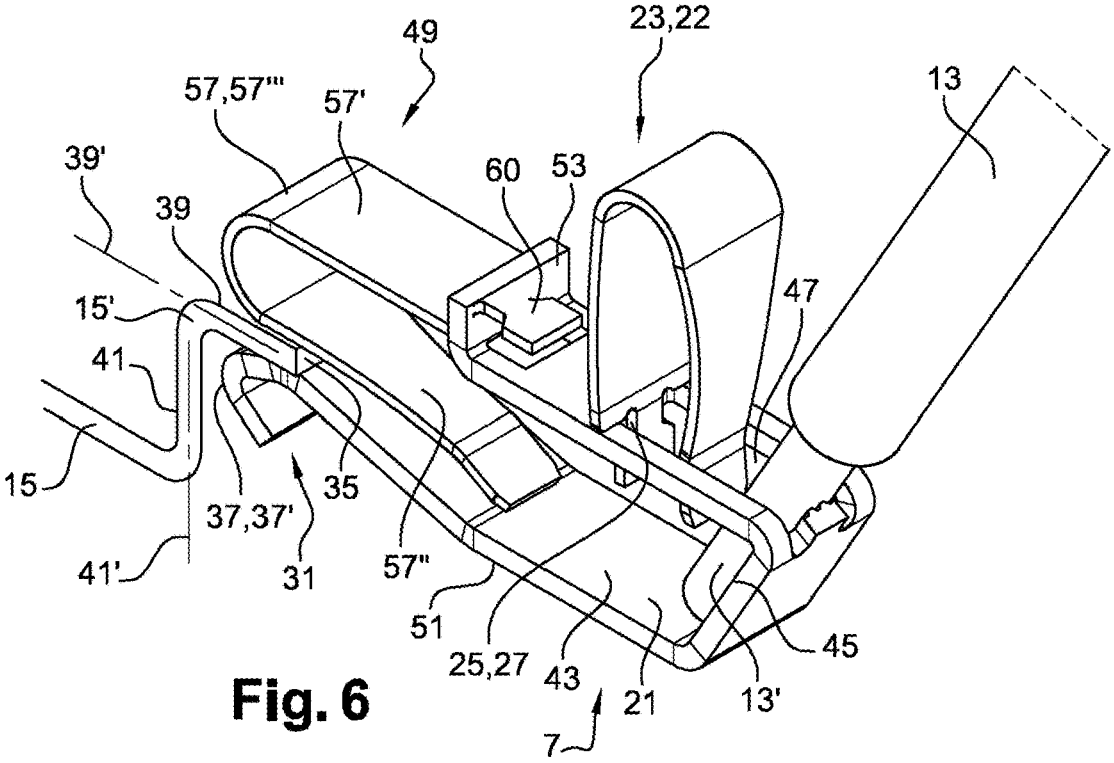
FIG. 6 is a perspective view of the variant of the electrical connection system, the electrical conductor and the support rail.
Figure 7:
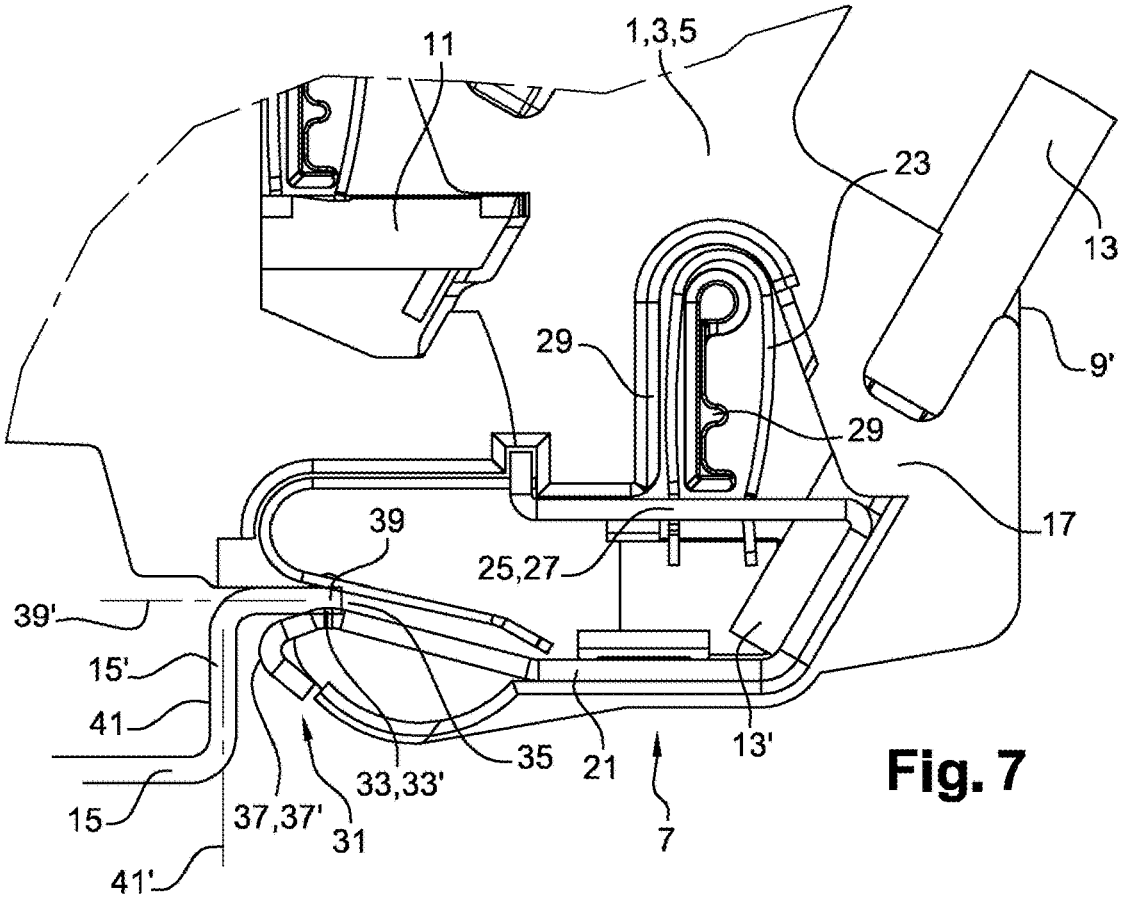
FIG. 7 is a front view of a detail of the junction block comprising the electrical connection system according to the variant.

As illustrated in FIGS. 1 to 7, an electrical apparatus 1 such as a junction block 3 comprises an insulating body 5 and an electrical connection system 7, the electrical connection system 7 being formed in the insulating body 5.

The junction block 3 comprises sockets 9 for electrical conductors. Two sockets 9 are linked by a linking bar 11 to establish an electrical contact between two corresponding conductors.

The junction block 3 also has a socket 9' for an electrical conductor 13 intended to be electrically connected to a support rail 15 on which the junction block 3 is removably fastened.

This electrical connection is established by the electrical connection system 9 as detailed hereinafter. The electrical conductor 13 has at one end a conductive portion 13' for example a metal tip.

The metal tip is arranged to be inserted into an insertion channel 17 of the socket 9' where it is held in position by the electrical connection system 7.

The socket 9' further comprises a maneuvering channel 19 in which a user can introduce a screwdriver type tool to remove the electrical conductor 13.

Figure 8:
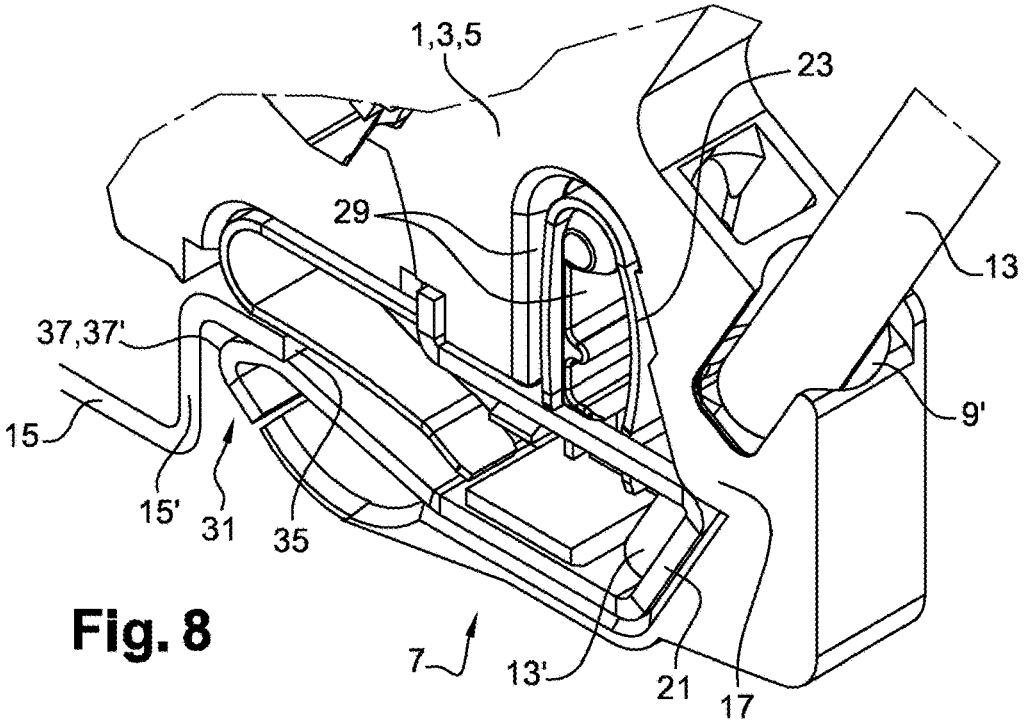
FIG. 8 is a perspective view of a detail of the junction block comprising the electrical connection system according to the variant.

As illustrated in FIGS. 4 to 8, the electrical connection system 7 comprises a conductive strip 21 arranged to transmit a current between the conductive portion 13' of the electrical conductor 13 and a portion 15' of the support rail 15.

The support rail 15 thus has a dual function since it enables fastening of the junction block 3 and is also used to be electrically connected to the electrical conductor 16.

The electrical connection system 7 also comprises a clamping device 22 of the leaf spring 23 type arranged to hold the conductive portion 13' in a connection position with the conductive strip 21 as illustrated in FIGS. 2 to 8.

According to other non-detailed alternatives, any other type of clamping device 22 could be used provided that the clamping device 22 is arranged to hold the conductive portion 13' in a connection position with the conductive bar 21. A screw clamping device 22 could for example be used.

The leaf spring 23 comprises a bearing branch 23' arranged to be mounted to the conductive strip 21. For this purpose, the conductive strip 21 has a depression 25 or a through opening resulting from a cutout adapted for the forced fitting of a fastening portion 27 of the bearing arm 23'.

The leaf spring 23 also comprises a clamping branch 23" joined by a hinge 23'" to the bearing branch 23'. The clamping branch 23" is arranged to hold the conductive portion 13' in the connection position.

Indeed, the bearing branch 23' is fixed relative to the conductive strip 21 and the hinge 23'" imposes a constraint on the conductive portion 13' via the clamping branch 23".

The maneuvering channel 19 is disposed so as to enable the displacement of the clamping branch 23" for removal of the electrical conductor 13.

The insulating body 5 has a support portion 29 of the bearing branch 23' having the function of blocking the bearing branch 23' during the displacement of the clamping branch 23".

The conductive strip 21 has a folded end portion 31 generating a first portion 33' of a cooperation area 35 or cooperation extension 33 and a second portion 37' of the cooperation area 35 or cooperation stop 37.

This first portion 33' of the conductive strip 21 is arranged to cooperate with a first complementary portion 39 of the support rail 15 extending in a first plane 39'.

This second portion 37' of the conductive strip 21 is arranged to cooperate with a second complementary portion 41 of the support rail 15 extending in a second plane 41' transverse to the first plane 39'.

The conductive strip 21 also has a longitudinal contact surface 43 on which are provided a location 45 for electrical connection with the conductive portion 13' in the connection position, the cooperation extension 33 and the cooperation stop 37.

The electrical connection location 45 extends rectilinearly in a profile generating one or several slot(s) for a better holding of the conductive portion 13' in the connection position.

The conductive strip 21 further has a passage opening 47 for the insertion of the conductive portion 13' in the connection position. This passage opening 47 results for example from a cutout performed before folding of the conductive strip 21.

The electrical connection system 7 also comprises a holding device 49 arranged to hold the support rail 15 in a cooperation position with the conductive strip 21.

The cooperation is achieved by contact, which enables a current transmission between the conductive strip 21 and the support rail 15.

The conductive strip 21 comprises a first portion 51 and a second portion 53 facing the first portion 51 at least partially.

The first portion 51 comprises the longitudinal contact surface 43 and the second portion 53 cooperates with the holding device 49. The fact of providing for these two portions 51, 53 allows making a compact electrical connection system 7 and/or adapting to geometrical constraints imposed on the junction block 3.

The conductive strip 21 can thus be obtained by a cutout in a base sheet metal and then by folding.

As illustrated in FIGS. 1 to 8, the conductive strip may have a U-like general shape. The first portion 51 and the second portion 53 are each formed in a different branch of the U.

The U-like general shape of the conductive strip 21 is obtained from a conductive blade cut from a base sheet metal. The blade is comprised within a rectangular contour which allows a saving of material by limiting the falls during the cutout. When cutting, the through openings are also created.

As more particularly shown in FIGS. 5 to 8, the holding device comprises an additional leaf spring 57. This additional leaf spring 57 may be similar to the leaf spring holding the conductive portion 13 in the connection position.

This arrangement allows a standardization of this part and the use of less references for the management of parts by the manufacturer, the holding device 49 being identical to the leaf spring 23.

The additional leaf spring 57 comprises an additional bearing branch 57' provided with an additional fastening portion 60 arranged to be fastened to an additional depression 59 of the conductive strip 21 similarly to the leaf spring 23 of the conductive portion 13.

The bearing branch 57" extends in the continuation of the second portion 53 of the conductive strip 21. This arrangement also allows reducing the size and therefore the material required for the manufacture of the conductive strip 21.

The additional leaf spring 57 also comprises an additional clamping branch 57" arranged to cooperate with the portion 15' of the support rail 15 in the cooperation position.

In the same way as the leaf spring 23, the additional leaf spring 57 comprises a hinge 57". Thus, the additional clamping branch 57" holds the portion 15' of the support rail 15 in the cooperation position.

The obtained electrical connection system 7 therefore comprises few parts, is compact and is capable of meeting geometrical constraints due to lack of space for its integration into the junction block.

As illustrated in FIGS. 1 to 4, the holding device 7 comprises, according to one variant, a C-shaped clamping spring 61 comprising a first end 61*a* and a second end 61*b* facing the first end 61*a*.

The clamping spring 61 therefore provides a clamping force between the two ends 61*a*, 61*b* thereof. It is arranged to maintain the cooperation between the portion 15' of the support rail 15 and the conductive strip 21 in the cooperation position.

The conductive strip 21 comprises a first connection branch 63*a* and a second connection branch 63*b* respectively movable relative to a contiguous first fixed base 65*a* and a second fixed base 65*b* contiguous to the conductive strip 21.

A support stud 67 ensures the displacement of the connection branches 63*a*, 63*b* while holding the fixed bases 65*a*, 65*b* in position. Thus, the connection branches 63*a*, 63*b* operate as a jaw clasping the portion 15' of the support rail 15 in the cooperation position.

The first connection branch 63*a* has a first through opening 69*a* and the second connection branch 61*b* has a second through opening 69*b*.

The first through opening 69*a* and the second through opening 69*b* face each other and are symmetrical with respect to a central plane 71.

Each through opening 69*a*, 69*b* generates two current passage channels 73, which enables a good current transmission in the conductive strip although material has been removed to form said opening.

Each connection branch 63*a*, 63*b* also has a cavity 75*a*, 75*b* in the form of a furrow extending aligned with the corresponding cooperation extension 33 in a direction transverse to the central plane 71.

A clamping location 77*a*, 77*b* is formed in said cavity 75*a*, 75*b* of each connection branch 63*a*, 63*b*.

A first clamping location 77*a* is arranged to receive the first end 61*a* of the clamping spring 61 and a second clamping location 77*b* is arranged to receive the second end 61*b*.

Each connection branch 63*a*, 63*b* comprises a cooperation extension 33. Since the clamping locations 77*a*, 77*b* and the cooperating extensions 33 are aligned transversely to the central plane 71, the clamping and the electrical contact are of good quality.

For a proper positioning of the clamping spring 61 during the introduction of the portion 15' of the clamping rail 15 in the cooperation position, the insulating body 5 has a centering wall 79.

During the mounting of the holding device 49, it is easy to introduce the clamping spring 61 through the through openings 96*a*, 69*b* then laterally pass the ends 61*a*, 61*b* of the clamping spring 61 in the cavities 75*a*, 75*b*.

The achieved clamping is also optimal because the clamping spring 61 is laterally centered with respect to the direction of extension of the conductive strip.

Hence, the described electrical connection system 7 features a simple constitution, an easy mounting enabling a good current transmission.

Of course, the invention is not limited to the sole embodiment of this electrical connection system, described above as example, it encompasses on the contrary all variants thereof.

The invention claimed is:

1. An electrical connection system for an electrical apparatus such as a junction block, the electrical connection system comprising:

a conductive strip having an electrical contact location arranged to cooperate with a conductive portion of an electrical conductor in a connection position and a cooperation area arranged to cooperate with a portion of a support rail in a cooperation position, a clamping device arranged to hold the conductive portion in the connection position, comprising a leaf spring comprising a bearing branch arranged to be mounted to the conductive strip and a clamping branch arranged to hold the conductive portion in the connection position, a holding device arranged to hold the support rail in the cooperation position, the conductive strip is constituted by a conductive blade comprising a first portion and a second portion, the first portion facing the second portion, the conductive blade being constituted of a transformed planar blade with a U-like general shape, the conductive strip having a passage opening for the insertion of the conductive portion in the connection position.

2. The electrical connection system according to claim 1, wherein the conductive strip comprises two connection branches each provided with a portion of the cooperation area.

3. The electrical connection system according to claim 1, wherein each connection branch has a through opening configured for the passage of a portion of the holding device into the cooperation position.

4. The electrical connection system according to claim 3, wherein the through openings of the connection branches face each other.

5. The electrical connection system according to claim 1, wherein each connection branch has a cooperation extension arranged to cooperate with the portion of the support rail in the cooperation position.

6. The electrical connection system according to claim 5, wherein the cooperation extensions of the connection branches extend along the same axis in the cooperation position.

7. The electrical connection system according to claim 6, wherein at least one connection branch further has a cooperation stop extending transversely to the cooperation extension.

8. The electrical connection system according to claim 3, wherein the holding device comprises a clamping spring provided with two ends facing each other, each end being arranged to cooperate with a clamping location of a corresponding connection branch.

9. The electrical connection system according to claim 8, wherein at least one clamping location is formed in a cavity of the corresponding connection branch, said location being arranged to receive a corresponding end of the clamping spring.

10. The electrical connection system according to claim 8, wherein the clamping spring is C-shaped.

11. The electrical connection system according to claim 1, wherein the holding device comprises an additional leaf spring provided with an additional bearing branch arranged to be mounted to the conductive strip and an additional clamping branch arranged to cooperate with the portion of the support rail in the cooperation position.

12. The electrical connection system according to claim 11, wherein the bearing branch extends in a plane transverse to the plane of extension of the additional bearing branch.

13. The electrical connection system according to claim 11, wherein the additional bearing branch extends in the continuation of the second portion of the conductive strip, the cooperation area being formed in the first portion of the conductive strip.

14. A junction block comprising an insulating body wherein an electrical connection system is formed according to claim 1.

15. The electrical connection system according to claim 2, wherein each connection branch has a through opening configured for the passage of a portion of the holding device into the cooperation position.

16. The electrical connection system according to claim 15, wherein the through openings of the connection branches face each other.

17. The electrical connection system according to claim 16, wherein each connection branch has a cooperation extension arranged to cooperate with the portion of the support rail in the cooperation position.

18. The electrical connection system according to claim 17, wherein the cooperation extensions of the connection branches extend along the same axis in the cooperation position.

19. The electrical connection system according to claim 18, wherein at least one connection branch further has a cooperation stop extending transversely to the cooperation extension.

* * * * *